US007075487B2

(12) United States Patent
Mattsson et al.

(10) Patent No.: US 7,075,487 B2
(45) Date of Patent: Jul. 11, 2006

(54) PLANAR INVERTED-F ANTENNA WITH EXTENDABLE PORTION

(75) Inventors: Jan-Ove U. Mattsson, Plantation, FL (US); Paloma I. Lampert, Plantation, FL (US); David Hartley Minasi, Fort Lauderdale, FL (US)

(73) Assignee: Motorola, Inc,, Schaumburg, IL (US)

( * ) Notice: Subject to any disclaimer, the term of this patent is extended or adjusted under 35 U.S.C. 154(b) by 0 days.

(21) Appl. No.: 10/892,858

(22) Filed: Jul. 16, 2004

(65) Prior Publication Data

US 2006/0012529 A1 Jan. 19, 2006

(51) Int. Cl.
*H01Q 1/24* (2006.01)

(52) U.S. Cl. ..... 343/702; 343/876

(58) Field of Classification Search ..... 343/702, 343/846, 725, 876

See application file for complete search history.

(56) References Cited

U.S. PATENT DOCUMENTS 6,252,554 B1 6/2001 Isohatala et al. ..... 343/702
6,452,558 B1 * 9/2002 Saitou et al. ..... 343/725
6,466,173 B1 10/2002 Li ..... 343/702
6,529,168 B1 * 3/2003 Mikkola et al. ..... 343/702
6,646,606 B1 11/2003 Mikkola et al. ..... 343/702
6,727,857 B1 * 4/2004 Mikkola et al. ..... 343/702
2003/0048227 A1 * 3/2003 Nakamura ..... 343/702

* cited by examiner

*Primary Examiner*—Hoang V. Nguyen

(57) ABSTRACT

An antenna structure (126) that includes a Planar Inverted-F Antenna (PIFA) (104) and an extendable portion such as a whip element (106). The PIFA (104) operates normally when the extendable portion (106) is retracted and upon extension, an electrical contact is made between the extendable portion (106) and the end (122) of the PIFA (104) that is electrically opposite, i.e., furthest along the electrically conductive path of the PIFA, from the feed structure (202, 208) for the PIFA (104). The electrical length of the composite antenna (126) is then substantially equal to the sum of the electrical length of the PIFA (104) and extendable portion (106). An embodiment disconnects the ground path of the PIFA feed structure upon extension of the extendable portion (106) to provide constant input impedance.

14 Claims, 4 Drawing Sheets

102

PLANAR INVERTED-F ANTENNA WITH EXTENDABLE PORTION

FIELD OF THE INVENTION

The present invention generally relates to the field of radio frequency antennas and more particularly to antennas with moveable elements.

BACKGROUND OF THE INVENTION

Small, portable wireless communications devices, such as cellular telephone, PDAs and the like, face increasing challenges associated with the design of effective wireless communications antennas. Internal antennas are able to be embedded in an appealing form factor and are often used in wireless communications devices. However, a fixed antenna, such as a Planar Inverted-F Antenna (PIFA), exhibits reduced performance when placed next to a users head, such as during a cellular phone call. This performance reduction is due, for example, to some blockage of the signal radiating to or from the antenna. This blockage and reduced performance can be a problem in areas where the wireless communications signal coverage is poor.

One way of overcoming this reduced performance problem is to add an extendable antenna part, such as a quarter-wave or half-wave whip, to enhance the RF performance of the portable handset. However, a half wave antenna in the 800–900 MHz band generally has a length that does not fit, when collapsed, into small portable handsets. Furthermore, quarter-wave whip antennas generally do not provide a significant performance improvement relative to a PIFA.

Therefore a need exists to overcome the problems with the prior art as discussed above.

SUMMARY OF THE INVENTION

According to a preferred embodiment of the present invention, an antenna has a PIFA element that has a feed end and a remote end. The feed end has an RF connection for driving the PIFA and the remote end is located at a location proximate to an end of the PIFA element that is electrically opposite from the feed end and that is electrically separated by an electrical length of the PIFA element from the feed end. The antenna further has a selectively engaging antenna contact that is electrically connected to the remote end. The antenna also has a moveable antenna element that is moveable between at least a first position and a second position. The antenna also has a feed contact, in physical and electrical connection with the moveable antenna element. The feed contact forms an ohmic RF path between the selectively engaging antenna contact and the moveable antenna element when the moveable antenna element is in the first position so that an ohmic RF path is created from the feed end through substantially the electrical length the PIFA element to the feed contact and through the moveable antenna element. The moveable antenna element is also electrically isolated from the PIFA element when it is at least in the second position.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

Figure 1:
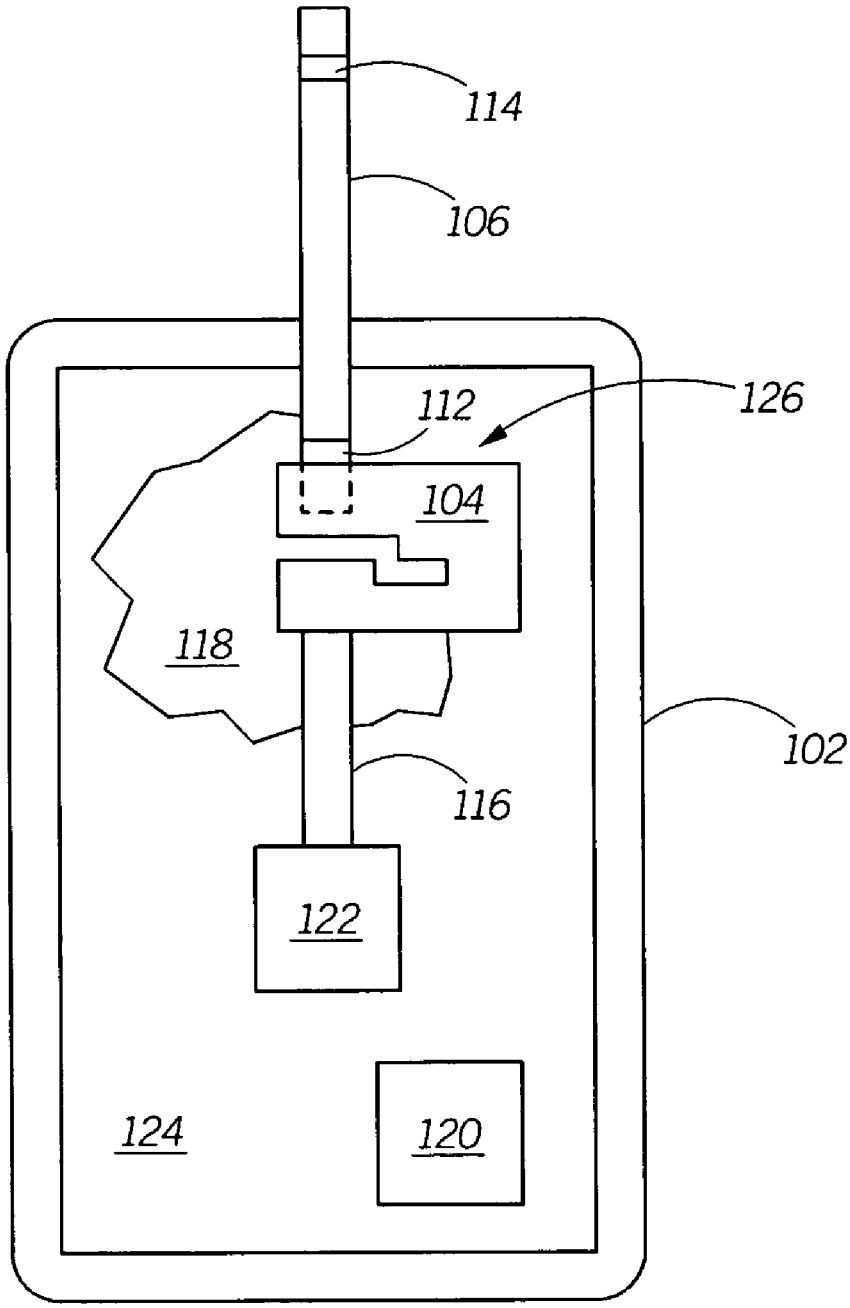
FIG. 1 illustrates a cellular telephone incorporating a PIFA antenna with extendable portion, according to an exemplary embodiment of the present invention.

FIG. 1 illustrates a cellular telephone 100 incorporating a Planar Inverted-F Antenna (referred to as "PIFA" herein) with extendable portion, according to an exemplary embodiment of the present invention. The exemplary cellular phone 100 includes a case 102 and an electronic circuit board 124.

The cellular telephone 100 has a composite antenna structure 126 that includes a PIFA element 104 and a whip antenna element 106. The whip antenna element 106 is an extendable antenna portion in this exemplary embodiment. The whip antenna element 106 of the exemplary embodiment is movable between the illustrated first position, in which it is extended, and a second position, which is illustrated below and in which the whip antenna element 106 is retracted. Whip antenna element 106 includes a feed contact 112 at its bottom end and a conductive band 114 near its top end. The operation of these components is described in more detailed below. PIFA antenna structure 104 is shown to be located near a ground plane area portion 118. Ground plane area portion 118 is an exemplary portion of a larger ground plane that extends over most of the electronic circuit board 124. The ground plane area portion 118 is shown for illustrative purposes to facilitate explanation of a connection between a ground connection on the PIFA element 104 and the ground plane of the electronic circuit board 124, which is detailed below.

The exemplary cellular phone 100 includes RF circuits 122 that include RF receiving circuits that receive signals from the antenna and recovers baseband signals therefrom and RF transmitting circuits that modulate and mix baseband signals and up-convert those baseband signals to RF signals that are transmitted via the composite antenna 126. The RF circuits 122 include an RF diplexing circuit that allows simultaneous transmission and reception. RF circuits 122 also include impedance matching circuits to improve coupling of RF energy between the RF circuits 122 and the antenna structure 126 of the exemplary cellular phone 100, as is understood by those of ordinary skill in the relevant arts. An RF feed line 116 connects an RF port of the RF circuits 122 to the antenna structure 126. The RF feed line 116 of the exemplary embodiment comprises a conductive trace transmission line formed on the circuit board 124. Further embodiments of the present invention utilize various RF feed line designs, such as coaxial cables and other structures and techniques. The RF circuits 122 and antenna structure 126 form a wireless communications section in this exemplary embodiment.

The exemplary cellular phone 100 further includes a baseband circuit 120 that processes data, audio, image, and video data, as communicated with a user interface circuit, such as speakers, display, cameras, keypads, buttons, touchpads, joysticks, and other interface circuits (all not shown), in a manner well known to those of ordinary skill in the art in order to interface this information with the RF circuits 122. Other electronic circuits within the wireless device 100 are included, such as a controller, memory storage, communications interfaces, audio signal conditioning circuits, data signal conditioning circuits, as is well known to those of ordinary skill in the relevant arts, but are not shown in order to enhance the clarity and understandability of this diagram.

The exemplary cellular phone 100 has a case 102 that is a housing and support structure for this exemplary embodiment. Electronic device housings, such as case 102, are able to be constructed in a variety of shapes and include a number of various human-machine interface features, such as keypads, displays, and so forth. Case 102 further forms a physical support for the antenna structure 126 of the exemplary embodiment. A movable portion of the antenna structure 126 is extended from and retracted into case 102, as is described herein.

Design techniques known to practitioners of ordinary skill in the relevant arts, including utilization of computer simulation software to model the electro-magnetic characteristics of antenna structures, are able to design such antenna structures to conform to a wide variety of case outlines and shapes.

Figure 2:
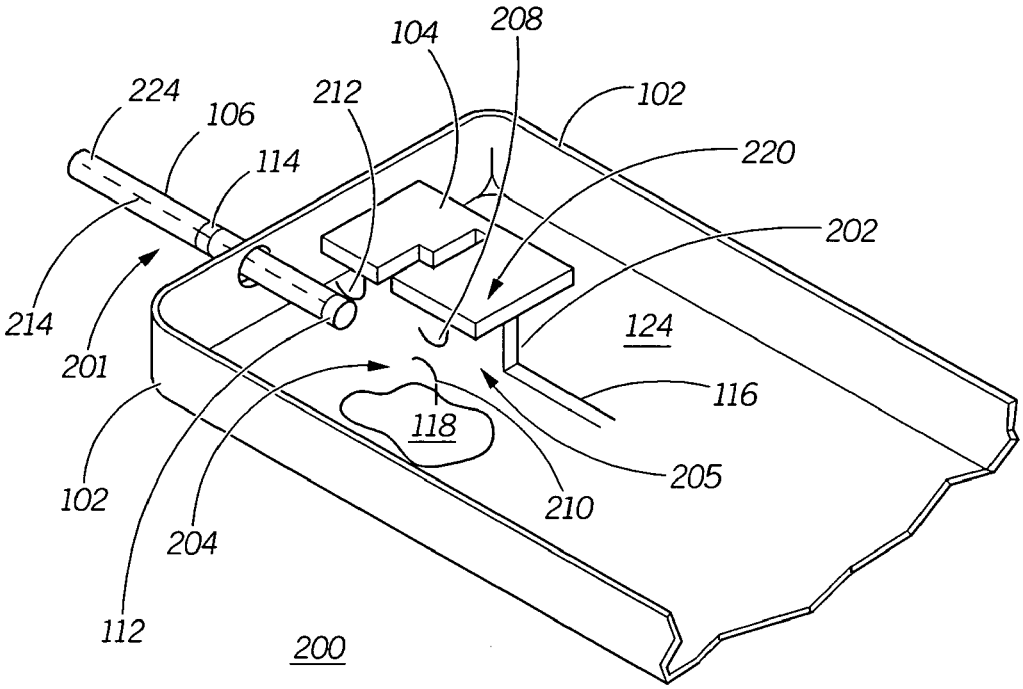
FIG. 2 illustrates a PIFA antenna with an extended extendable portion according to an exemplary embodiment of the present invention.

FIG. 2 illustrates a PIFA antenna arrangement 200 with an extended extendable portion 201, according to an exemplary embodiment of the present invention. The PIFA antenna arrangement 200 with an extended extendable portion 201 illustrates a PIFA element 104 that includes an RF connection 205 located at a feed end 220 of the PIFA element 104. The PIFA antenna arrangement 200 with an extendable portion 201 further includes the whip antenna element 106 in this exemplary embodiment. The whip antenna element 106 comprises the extendable portion of the antenna and is shown in this figure in its extended position. In the extended position of the whip antenna element 106 that is illustrated in this figure, the whip antenna element 106 is mostly extended from the case or housing 102 so as to more efficiently radiate and receive RF energy.

The RF connection 205 of this exemplary embodiment has an RF feed 202 and a portion of a ground path 204 that includes a top ground contact 208 and a bottom ground contact 210. The RF feed 202 is ohmically connected to the RF line 116 to send and receive RF energy between the RF connection 205 and the RF circuits 122.

The top ground contact 208 is connected to the feed end 220 of the PIFA element 104. The bottom ground contact 210 is connected to ground plane portion 118 in the exemplary embodiment. As illustrated, the top ground contact 208 is electrically separated from the bottom ground contact 210 in this configuration. This causes the portion of the ground path 204 as shown in this figure to be open when the whip antenna element 106 is in its extracted or extended position 201. A completed ground path 204, which is realized when the whip antenna element 106 is its retracted position, is described below.

PIFA element 104 is further shown to include a selectively engaging antenna contact 212. The selectively engaging antenna contact 212 is located proximate to a remote end 222 of the PIFA element 104. The remote end 222 of the PIFA element 104 is the end of the PIFA element 104 that is reached by electrical currents that follow the longest path along the conductive path of the PIFA element 104 from the feed end 220. As is known to ordinary practitioners in the relevant arts, this conductive distance, which is referred to herein as the electrical length of the PIFA element, is on the order of one fourth of the wavelength of RF signals for which the PIFA element 104 is designed to operate. This results in the remote end 222 of the PIFA element 104 being electrically separated from the feed end 220 by this electrical length of approximately one fourth of a wavelength of RF signals for which the PIFA element 104 is designed to operate. It is clear that the remote end 222 is electrically opposite from the feed end 220, since the electrical path between these two points is the longest conductive path in the PIFA element 104. Embodiments of the present invention place the selectively engaging antenna contact 212 only proximately to, but not necessarily at, the remote end 222 of the PIFA element.

Whip element 106 is shown to include a feed contact 112 and a whip radiator 214. The whip radiator 214 is an electrically conductive element, in the exemplary embodiment, that forms an RF radiation element. The whip radiator 214 is enclosed with a substantially electrically insulating material 224 that coats the whip radiator 214 and electrically isolates the whip radiator 214 along its length. Whip radiator 214 is in electrical contact with feed contact 112. Feed contact 112 is an electrically conductive area formed on the bottom portion of whip element 106. Feed contact 112 is urged into physical and electrical contact with the selectively engaging antenna contact 212 and thereby forms an ohmic contact between the selectively engaging antenna contact 212 and the whip radiator 214 of the whip antenna 106 when the whip antenna 106 is in its extended or first position.

As illustrated in FIG. 2, the PIFA element 104 and whip radiator 214, in conjunction with feed contact 112 and selectively engaging antenna contact 212, create an ohmic RF path from the feed end 220, through substantially the electrical length the PIFA element 104 to the feed contact 112 and on through the moveable antenna element 106 when the movable antenna element 106 is in its extended or first position. In the exemplary embodiment, the PIFA element 104 has an electrical length from the feed end 220 to the remote end 222 of one fourth of the wavelength of RF signals for which the PIFA with an extended extendable portion 201 is designed to operate. The whip radiator 214 has an equal electrical length, i.e., an electrical length that is also one fourth of the wavelength of RF signals for which the composite antenna structure 126 is designed to operate. The PIFA with an extended extendable portion 200 therefore has a total electrical length essentially equal to one half of the RF wavelength of RF signals with the nominal RF wavelength at which the PIFA with an extended extendable portion 201 is designed to transmit and receive RF signals.

Further embodiments of the present invention include PIFA elements combined with whip elements 106 that have whip radiators 214 that have electrical lengths that are equal to three fourths of the nominal RF wavelength of RF signals for which the PIFA with an extended extendable portion 201 is designed to operate. For example, an electrical length of the PIFA element 104, which is one fourth wavelength of the RF signals for which it is designed to operate, and an electrical length of the whip radiator 214 of three fourths of the wavelength of the RF signal for which the composite antenna 126 is designed to operate provides an antenna with a total electrical length equal to one full wavelength of RF signals of the nominal RF wavelength of RF signals for which the a PIFA with an extended extendable portion 201 is designed to operate.

Further embodiments utilize whip antennas that have electrical lengths that are greater than or less than one fourth of the wavelength of RF signals with the nominal RF wavelength at which the PIFA with an extendable portion 201 is designed to operate. Yet further embodiments have whip antennas with nominal electrical lengths that are integer multiples of one fourth wavelength of the RF signals for which the PIFA with an extendable portion is designed to operate. Additional embodiments utilize whip antennas with any possible lengths, as should become obvious to those of ordinary skill in the art in view of the present discussion.

Figure 3:
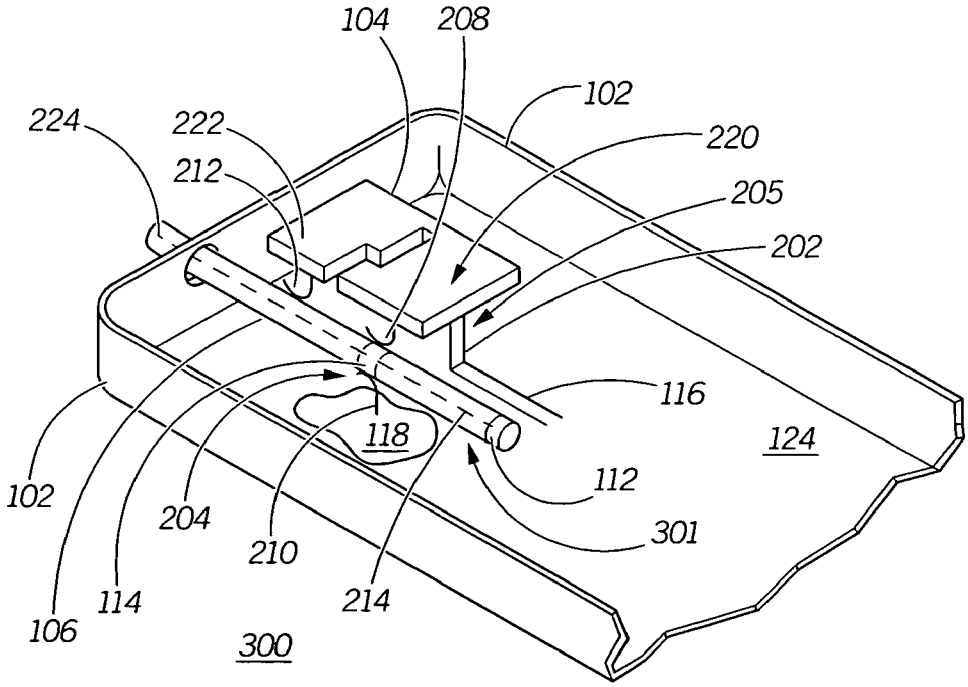
FIG. 3 illustrates a PIFA antenna with a retracted extendable portion according to an exemplary embodiment of the present invention.

FIG. 3 illustrates a PIFA antenna arrangement 300 with a retracted extendable portion 301, according to an exemplary embodiment of the present invention. In its retracted position 301, the whip element 106 is shown to be substantially contained within the case or housing 102 of the wireless device. Feed contact 112 is shown to be remote from any RF connections, and therefore the moveable antenna element of whip radiator 214 is electrically isolated from the PIFA element 104 when the whip element 106 is in its retracted, or second, position 301.

The whip antenna 106 has a conductive band 114 that is an electrically conductive element that is physically mounted on the substantially electrically insulating material 224 enclosing the whip radiator 214 and is therefore physically attached to the whip radiator 214. The conductive band 114 is electrically isolated from the whip radiator 214 by being mounted on the outside of the substantially electrically insulating material 224. As shown in FIG. 3, when the whip antenna 106 is in its retracted position, conductive band 114 is in physical and electrical contact with the top ground contact 208 and the bottom ground contact 210, thereby forming a conductive path therebetween. The combination of the top ground contact 208, the bottom ground contact 210, and the conductive band 114 when so positioned, form the ground path 204 for the RF connection 205 of the exemplary embodiment The mounting of the conductive band 114, as illustrated in FIG. 3, provides an electrically conductive element 106 that is positioned in relation to the moveable antenna element so as to close the ground path 204 when the moveable antenna element 106 is in its retracted, or second, position 301.

The above described exemplary embodiment operates to maintain acceptably constant input impedance for the PIFA antenna with extendable portion 126 when the whip element 106 is in both the extended 201 and retracted 301 positions by electrically isolating the ground path 204 of the RF connection 205 of the PIFA antenna 104 when the whip antenna 106 is in its extracted position 201. Further embodiments include a switchable impedance matching circuits that are electrically connected to the RF connection 205 of the PIFA element 104. These switchable impedance matching circuits selectively place at least one of a first impedance and a second impedance in series with the RF connection 205 such that the first impedance is placed in series with the composite antenna structure 126 when the moveable antenna element, such as whip element 106, is in the first position and the second impedance is placed in series with the composite antenna structure 126 when the moveable antenna element 106 is in the second position 301. These embodiments utilize various means to electrically sense the position of the moveable antenna element 106, such as electrical contacts and the like.

The above illustrated embodiment of the present invention opens and closes the ground path 204 of the RF connection by a mechanical switching arrangement including a conductive band 114 placed on the moveable antenna element 106. Further embodiments of the present invention open and close the ground path 204 for the RF connection 205 by other means, such as electrically operated switches and the like.

Figure 4:
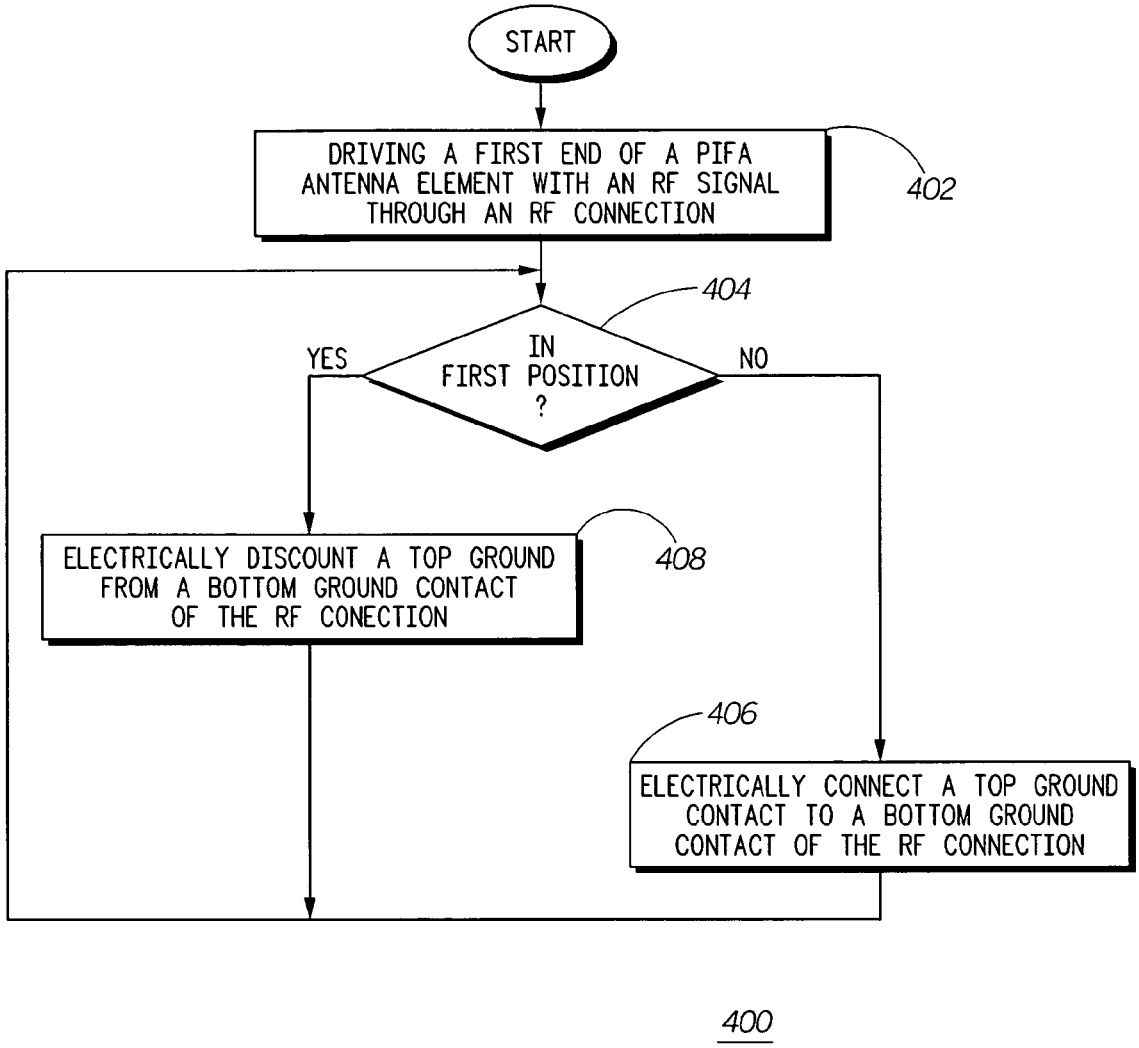
FIG. 4 illustrates a processing flow diagram as performed by an exemplary embodiment of the present invention.

FIG. 4 illustrates a processing flow diagram 400 as performed by an exemplary embodiment of the present invention. The processing flow begins by driving, at step 402, a first end 220 of a PIFA element 104 with an RF signal. The processing advances by determining, at step 404, whether the moveable antenna element 106 is in a first position 201. The processing then selectively electrically disconnects, at step 408, top ground contact 208 from bottom ground contact 210 of ground path 204 if it was determined that the movable antenna element 106 is in the first position 201. The second end 220 is electrically opposite from the first end 222 of the PIFA element 104 so as to form an ohmic RF path from the first end 220 through substantially an electrical length of the PIFA element 104 to the second end 222 and through the whip radiator 214 of the moveable antenna element 106. Otherwise, the processing selectively electrically connects, at step 406, top ground contact 208 from bottom ground contact 210 of ground path 204 when the movable antenna element 106 is in at least one position away from the first position 201. This processing is performed in the exemplary embodiment by also selectively electrically connecting a moveable antenna element to a second end of the PIFA element when the movable antenna element is in a first position, the second end being electrically opposite from the first end so as to form an ohmic RF path from the first end through substantially an electrical length the PIFA element to the second end and through the moveable antenna element. The processing then returns to determine, at step 404, if the movable antenna element is in the first position 201 and the processing continues as described above.

Figure 5:
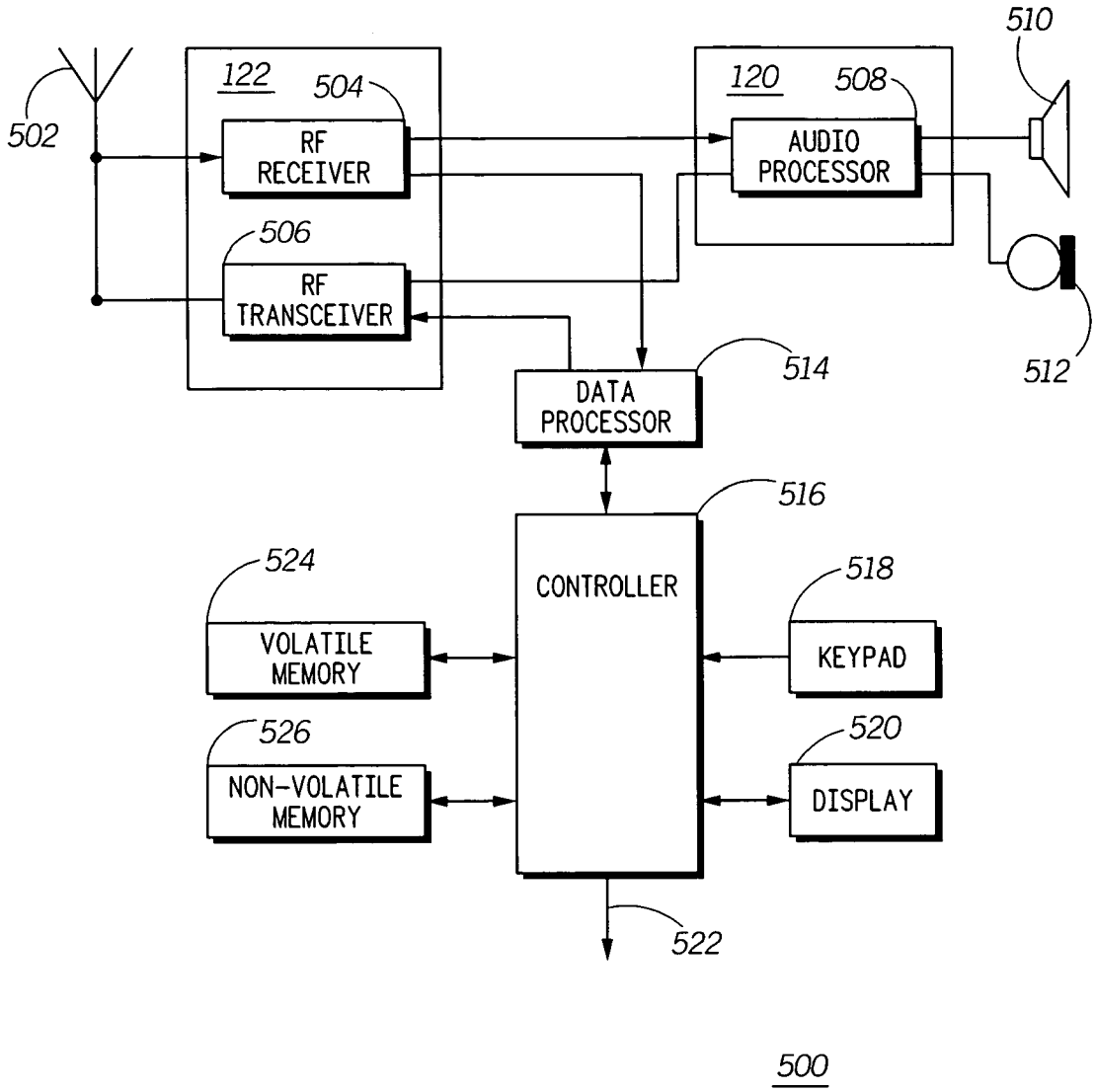
FIG. 5 illustrates a cellular phone block diagram according to an exemplary embodiment of the present invention.

FIG. 5 illustrates a cellular phone block diagram 500 according to an exemplary embodiment of the present invention. The cellular phone block diagram 500 illustrates the circuits included in a cellular phone, such as the exemplary cellular phone 100. The cellular phone block diagram 500 includes an RF antenna 502, a receiver 504 and RF transmitter 506. The RF transmitter 506 and RF receiver 504 are contained in the RF circuits 122 of the exemplary embodiment and are connected to the RF antenna 502 in order to support bidirectional RF communications. The RF antenna 502 includes the composite antenna structure 126 in the exemplary embodiment. The cellular phone 100 is able to simultaneously transmit and receive voice and/or data signals to and from a base station (not shown). The RF receiver 504 provides voice data to an audio processor 508 (in the baseband circuit 120), and the audio processor 508 provides voice data to the RF transmitter 506 to implement voice communications. The audio processor 508 obtains voice signals from microphone 510 and provides voice signals to speaker 512. The RF receiver 504, RF transmitter 506, Audio processor 508, microphone 510 and speaker 512 operate to communicate voice signals to and from the exemplary cellular phone 100 in manners similar to those used by conventional cellular phone.

The cellular phone block diagram 500 includes a controller 516 that controls the operation of the cellular phone 100 in the exemplary embodiment. Controller 516 is connected to the various components of the cellular phone block diagram 500 via control bus 522. Controller 516 also communicates data to external devices, such as a base station and/or a server, through a wireless link (not shown). Controller 516 provides data to and accepts data from data processor 514. Data processor 514 of the exemplary embodiment performs communications processing necessary to implement over-the-air data communications to and from external stations. Data processor 514 provides data for transmission to the RF transmitter 506 and accepts received data from RF receiver 504.

Controller 516 provides visual display data to the user through display 520. Display 520 of the exemplary embodiment is a Liquid Crystal Display that is able to display alphanumeric and graphical data. Controller 514 also accepts user input from keypad 518. Keypad 518 is similar to a conventional cellular phone keypad and has buttons to accept user input in order to support operation of the exemplary embodiment of the present invention.

Controller 516 of the exemplary embodiment stores and retrieves data from volatile memory 524 and non-volatile memory 526. Non-volatile memory 526 includes computer program products and other data that changes infrequently to support operation of the cellular phone 100. Although non-volatile memory 526 contains data that does not routinely change during the operation of cellular phone 100, the contents of the non-volatile memory 526 are able to be changed when reprogramming is desired. Non-volatile memory 526 is able to consist of Electrically Erasable Programmable Read-Only Memory (EEPROM) and other such devices known to ordinary practitioners in the relevant arts. Volatile memory 525 stores data that can change during normal operation of the cellular phone 100, and consists of Random Access Memory (RAM) in the exemplary embodiment.

The exemplary embodiments of the present invention advantageously provide a compact, inexpensively manufactured antenna structure that is easily incorporated into portable wireless devices. These exemplary embodiments further provide an antenna structure with a retractable whip element that operates efficiently when the whip element is retracted and provides enhanced operation when the whip element is extracted.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. An antenna, comprising:

a PIFA element having a feed end and a remote end, the feed end having an RF connection for driving the PIFA element and the remote end located at a location proximate to an end of the PIFA element that is electrically opposite from the feed end and electrically separated from the feed end by an electrical length of the PIFA element;

a selectively engaging antenna contact electrically connected to the remote end;

a moveable antenna element being moveable between at least a first position and a second position; and a feed contact, in physical and electrical connection with the moveable antenna element, the feed contact forming an ohmic RF path between the selectively engaging antenna contact and the moveable antenna element when the moveable antenna element is in the first position so that an ohmic RF path is created from the feed end through substantially the electrical length the PIFA element to the feed contact and through the moveable antenna element, and wherein the moveable antenna element is electrically isolated from the PIFA element when in a position other than the first position;

wherein the RF connection comprises an RF path and a ground path, wherein the ground path is opened when the moveable antenna element is in the first position and is closed when the moveable antenna is in at least the second position.

2. The antenna of claim 1, wherein the moveable antenna element comprises a whip antenna.

3. The antenna of claim 2, wherein the first position comprises having the whip antenna extended from a housing.

4. The antenna of claim 2, wherein the second position comprises having the whip antenna retracted into a housing.

5. The antenna of claim 2, wherein the moveable antenna element is physically attached to and electrically isolated from an electrically conductive element, the electrically conductive element positioned in relation to the moveable antenna element so as to close the ground path when the moveable antenna element is at least in the second position.

6. The antenna of claim 1, further comprising a switchable impedance matching circuit, electrically connected to the RF connection, that selectively places one of at least one of a first impedance and a second impedance in series with the RF connection such that the first impedance is placed in series when the moveable antenna element is in the first position and the second impedance is placed in series when the moveable antenna element is a position other than the first position.

7. The antenna according to claim 1, wherein the antenna is designed to at least one of transmit and receive an RF signal at a nominal RF wavelength, and wherein an electrical RF length from the feed end, through substantially the electrical length the PIFA element to the feed contact, and through the moveable antenna element, is substantially equal to one half of the nominal RF wavelength.

8. The antenna according to claim 1, wherein the antenna is designed to at least one of transmit and receive an RF signal at a nominal RF wavelength, and wherein an electrical RF length of the moveable antenna element is essentially equal to one fourth of the nominal RF wavelength.

9. The antenna according to claim 1, wherein the antenna is designed to perform at least one of transmit and receive an RF signal at a nominal RF wavelength, and wherein an electrical RF length from the feed end, through substantially the electrical length the PIFA element to the feed contact, and through the moveable antenna element, is essentially equal to the RF wavelength.

10. A wireless communications device, comprising:

at least one of a receiver for wirelessly receiving transmitted signals and a transmitter for wirelessly transmitting signals;

a PIFA element having a feed end and a remote end, the feed end having an RF connection electrically connected to the at least one receiver and transmitter, the RF connection for at least one of driving RF signals to the feed and receiving RF signals from the feed end, and the remote end located at a location proximate to an end of the PIFA element that is electrically opposite from the feed end and electrically separated from the feed end by an electrical length of the PIFA element;

a selectively engaging antenna contact electrically connected to the remote end;

a moveable antenna element moveable between at least a first position and a second position; and a feed contact, in physical and electrical connection with the moveable antenna element, the feed contact forming an ohmic RF path between the selectively engaging antenna contact and the moveable antenna element when the movable antenna element is in the first position so that an ohmic RF path is created from the feed end through substantially the electrical length the PIFA element to the feed contact and through the moveable antenna element and wherein the moveable antenna element is electrically isolated from the PIFA element when in other than the first position;

wherein the RF connection comprises an RF path and a ground path, wherein the ground path is opened when the moveable antenna element is in the first position and is closed when the moveable antenna is in at least the second position.

11. The wireless communications device of claim 10, wherein the moveable antenna element comprises a whip antenna.

12. The wireless communications device of claim 10, further comprising a switchable impedance matching circuit, electrically connected to the RF connection, that selectively places one of at least one of a first impedance and a second impedance in series with the RF connection such that the first impedance is placed in series when the moveable antenna element is in the first position and the second impedance is placed in series when the moveable antenna element is a position other than the first position.

13. The wireless communications device of claim 10, wherein the antenna is designed to at least one of transmit and receive an RF signal at a nominal RF wavelength, and wherein an electrical RF length of the moveable antenna element is essentially equal to one fourth of the nominal RF wavelength.

14. The wireless communications device of claim 10, wherein the moveable antenna element is physically attached to and electrically isolated from an electrically conductive element, the electrically conductive element positioned in relation to the moveable antenna element so as to close the ground path when the moveable antenna element is at least in the second position.

* * * * *